US006736481B2

(12) United States Patent
Urrutia et al.

(10) Patent No.: US 6,736,481 B2
(45) Date of Patent: May 18, 2004

(54) SYSTEM AND METHOD FOR CLEANING INK EJECTION ELEMENTS

(75) Inventors: Martin Urrutia, Sant Cugat del Valles (ES); Antonio Monclus, Castelldefels Barcelona (ES); Gonzalo Gaston, Barcelona (ES)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 09/984,904

(22) Filed: Oct. 31, 2001

(65) Prior Publication Data

US 2003/0081051 A1 May 1, 2003

(51) Int. Cl.[7] ..... B41J 2/165
(52) U.S. Cl. ..... 347/22; 347/29; 347/33
(58) Field of Search ..... 347/22, 29, 30, 347/31, 32, 33, 35

(56) References Cited

U.S. PATENT DOCUMENTS 5,552,811 A * 9/1996 Kurata et al. ..... 347/28
5,635,965 A 6/1997 Purwins et al. ..... 347/31
5,694,157 A * 12/1997 Ahlvin ..... 347/24
5,997,128 A * 12/1999 Lou et al. ..... 347/33
6,155,667 A * 12/2000 Eckard et al. ..... 347/33

FOREIGN PATENT DOCUMENTS

EP 0 744 294 A1 * 11/1996
JP 4-338552 * 11/1992 ..... 347/33

* cited by examiner

*Primary Examiner*—Shih-Wen Hsieh

(57) ABSTRACT

Absorbent pads are provided at various positions on a substrate of a service station. The substrate may be in the form of a device intended to be implemented during a capping operation of an ink ejection elements, e.g., printheads, pens, etc. The various positions on the substrate generally correspond to various locations on the ink ejection element that are known to accumulate ink and other debris. During use, the substrate is drawn near the ink ejection element to thereby cause contact between the absorbent pads and the various locations. The relative movement between the substrate and the ink ejection element is substantially vertical to thereby greatly reduce the possibility of the absorbent pad damaging the nozzles of the ink ejection element. Absorbent pads are also provided on upstanding members of the substrate to substantially remove ink and debris that may accumulate on the sides of the ink ejection element.

23 Claims, 7 Drawing Sheets

SYSTEM AND METHOD FOR CLEANING INK EJECTION ELEMENTS

RELATED APPLICATION

The following commonly assigned application, filed on Oct. 31, 2001, may contain some common disclosure and may relate to the present invention. Thus, the following application is hereby incorporated by reference:

U.S. patent application Ser. No. 09/934,941, entitled "SYSTEM AND METHOD FOR DRAINING INK FROM INK RECEIVING DEVICES" (Attorney Docket No. HP 60017861-1).

FIELD OF THE INVENTION

This invention relates generally to printing devices. More specifically, the present invention relates to capping systems and methods for capping ink ejection elements.

BACKGROUND OF THE INVENTION

Inkjet printing mechanisms, e.g., printers, photocopiers, facsimile machines, etc., typically implement inkjet cartridges, often called "pens" to shoot drops of ink onto a sheet of print media, e.g., paper, fabric, textile, and the like. Pens typically have multiple printheads that include very small nozzles on an orifice plate through which the ink drops are fired.

The particular ink ejection mechanism within the printhead may take on a variety of different forms as known to those skilled in the art, such as those using piezoelectric or thermal inkjet technology. To print an image, the printhead is scanned back-and-forth across a print zone above the sheet, with the pen shooting drops of ink as it moves. By selectively firing ink through the nozzles of the printhead, the ink is expelled in a pattern on the print media to form a desired image (e.g., picture, chart, text and the like).

The orifice plate of the printhead has a tendency to pick up contaminants, such as paper dust, dried ink and the like, during the printing process. Such contaminants may adhere to the orifice plate either because of the presence of ink on the printhead, or because of electrostatic charges. In addition, excess dried ink can accumulate around the printhead. The accumulation of either ink or other contaminants can impair the quality of the output by interfering with the proper application of ink to the print media. In addition, if color pens are used, each printhead may have different nozzles which each expel different colors. If ink accumulates on the orifice plate, mixing of different colored inks (cross-contamination) can result which may lead to adverse affects on the quality of the resulting printed product. Furthermore, the nozzles may become clogged, particularly if the printheads are left uncapped for a relatively long period of time. For at least these reasons, it is desirable to clear the printhead orifice plate of such contaminants on a substantially routine basis.

In this respect, servicing operations, including ink drop detections, wiping and capping of the orifice plate, and the like, are typically performed during, and/or after completion of the performance of a printing operation. In performing the servicing operations, inkjet printing mechanisms typically implement a service station located along the scanning direction. The service station is typically equipped with a plurality of components designed to carry out the servicing operations.

The wiper is designed to scrape off paper dust or other debris that may accumulate on the orifice plate as well as various other portions of the printheads. These wipers are typically made of a elastomeric material, for instance a nitrile rubber, ethylene polypropylene diene monomer (EPDM) elastomer, or other types of rubber-like materials. The wiping action is usually achieved by either moving the printhead across the wiper, or moving the wiper across the printhead. Unfortunately, such wiping operations have oftentimes been found to be inadequate to effectively remove paper dust and other debris. In addition, such wiping actions may cause excess ink to build up on the lower side portions of the printheads as well as degradation of the wiper itself. Furthermore, ink may become dried on the surface of the wiper and may cause it to become less effective.

The capping operation is typically performed through use of a cap. The cap is normally composed of a substrate that supports a seal for humidically sealing the printhead nozzles from contaminants and drying. Typically, the seal is an elastomeric enclosure having sealing lips which surround the nozzles and form an air-tight seal at the printhead face (i.e., nozzle plate). The cap is typically maneuvered into position on the printhead through vertical motion of the cap from the service station. The cap is not equipped to clean off the nozzle plate or the printhead but merely provides a seal to protect the nozzles.

SUMMARY OF THE INVENTION

According to a preferred embodiment, the present invention pertains to a system for cleaning an ink ejection element having a plurality of nozzles. The system includes a device having a substrate supporting at least one absorbent pad located at a first location on the substrate. The first location corresponds to a second location on the ink ejection element and the second location is free of the plurality of nozzles. In this respect, the at least one absorbent pad is substantially prevented from contacting any of the plurality of nozzles.

According to an aspect, the present invention relates to a method of cleaning ink ejection elements of an image forming mechanism having a plurality of nozzles. In the method, a device having at least one absorbent pad is maneuvered in a substantially vertical direction towards a bottom surface of the image forming mechanism. The at least one absorbent pad is contacted with a predetermined location on the image forming mechanism when the device is substantially close to the image forming mechanism to thereby remove debris from the image forming mechanism. In addition, the predetermined location does not include any of the plurality of nozzles.

According to another aspect, the present invention pertains to an image forming mechanism. The mechanism includes an ink ejection element having a plurality of nozzles. The ink ejection element is configured to undergo cleaning operations at a service station. The service station includes a wiper for selectively wiping the ink ejection element and a carriage movably supporting a cleaning device. The cleaning device includes at least one absorbent pad. The at least one absorbent pad is positioned on the cleaning device to substantially prevent contact with any of the plurality of nozzles when the ink ejection element is cleaned with the cleaning device.

In comparison to known printing mechanisms and techniques, certain embodiments of the invention are capable of achieving certain advantages, including, little to no risk of scratching or otherwise damaging the nozzles of ink ejection elements with the absorbent pads, placement of the absorbent pads generally enables removal of waste ink and other debris at selective locations on the ink ejection elements, the absorbent pads may be utilized for relatively long periods of time by virtue of the lack of relative sliding movement between the absorbent pads and the ink ejection element, and the embodiments of the present invention may be implemented in conjunction with pre-existing capping systems in a relatively simple manner. Those skilled in the art will appreciate these and other advantages and benefits of various embodiments of the invention upon reading the following detailed description of a preferred embodiment with reference to the below-listed drawings.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structures have not been described in detail so as not to unnecessarily obscure the present invention.

According to an exemplary embodiment of the present invention, ink ejection elements, e.g., printheads, pens, etc., may be maintained in relatively good operating condition by utilization of a capping system designed to clear excess ink and debris from the ink ejection elements. Preferably, the capping system includes at least one absorbent pad located at a predetermined location on a capping device. The predetermined location is selected to mate the at least one absorbent pad with a particular location on the ink ejection element, e.g., on a location where ink and debris are known to accumulate.

Figure 1:
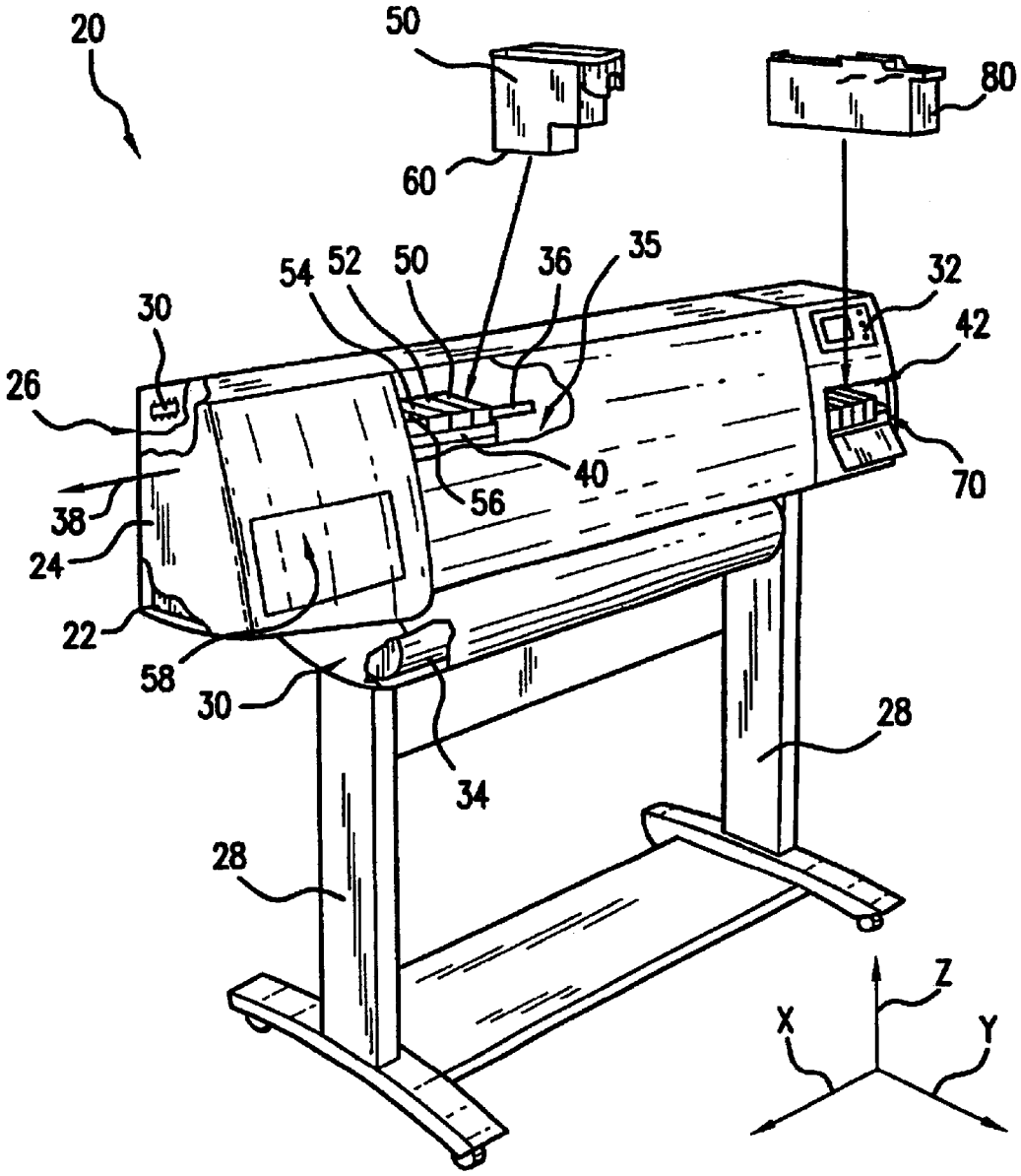
FIG. 1 is a perspective view of one form of an inkjet printing mechanism, here an inkjet printer having a plurality of scanning ink ejection elements.

FIG. 1 illustrates an embodiment of a printer 20 constructed in accordance with the principles of the present invention, which may be used for recording information onto a recording medium, such as, paper, textiles, and the like, in an industrial, office, home or other environment. The present invention may be practiced in a variety of printers. For instance, it is contemplated that an embodiment of the present invention may be practiced in large scale textile printers, desk top printers, portable printing units, copiers, cameras, video printers, and facsimile machines, to name a few. For convenience, the concepts of the present invention are illustrated in the environment of a printer 20.

While it is apparent that the printer components may vary from model to model, the printer 20 includes a chassis 22 surrounded by a housing or casing enclosure 24, typically of a plastic material, together forming a print assembly portion 26 of the printer 20. While it is apparent that the print assembly portion 26 may be supported by a desk or tabletop, it is preferred to support the print assembly portion 26 with a pair of leg assemblies 28. The printer 20 also has a printer controller 30, illustrated schematically as a microprocessor, that receives instructions from a host device, typically a computer, such as a personal computer or a computer aided drafting (CAD) computer system (not shown). A manner in which the controller 30 operates will be described in greater detail hereinbelow.

The printer controller 30 may also operate in response to user inputs provided through a key pad and status display portion 32, located on the exterior of the casing 24. A monitor coupled to the host device may also be used to display visual information to an operator, such as the printer status or a particular program being run on the host device. Personal and drafting computers, their input devices, such as a keyboard and/or a mouse device, and monitors are all well known to those skilled in the art and are thus not illustrated in FIG. 1.

A conventional recording media handling system (not shown) may be used to advance a continuous sheet of recording media 34 from a roll through a print zone 35. Moreover, the illustrated printer 20 may also be used for printing images on pre-cut sheets. The recording media may be any type of suitable sheet material, such as paper, poster board, fabric, transparencies, mylar, and the like. A carriage guide rod 36 is mounted to the chassis 22 to define a scanning axis 38, with the guide rod 36 slideably supporting a carriage 40 for travel back and forth, reciprocally, across the print zone 35. A conventional carriage drive motor (not shown) may be used to propel the carriage 40 in response to a control signal received from the controller 30. To provide carriage positional feedback information to controller 30, a conventional metallic encoder strip (not shown) may extend along the length of the printzone 35 and over a servicing region 42. A conventional optical encoder reader may be mounted on the back surface of carriage 40 to read positional information provided by the encoder strip in a manner generally known to those of skill in the art.

In the print zone 35, the recording medium receives ink from four cartridges 50–56. Although four cartridges 50–56 are illustrated, it is within the purview of the present invention that the printer may contain any reasonably suitable number of cartridges, e.g., two, six, eight, twelve, and the like. For purposes of simplicity and illustration, printer 20 will be described in terms of the four cartridges. Thus, more or less numbers of cartridges may be implemented in the same or like manner as described hereinbelow with respect to cartridges 50–56. The cartridges 50–56 are also often called "pens" by those in the art. One of the pens, for example pen 50, may be configured to eject black ink onto the recording medium, where the black ink may contain a pigment-based ink. Pens 52–56 may be configured to eject variously colored inks, e.g., yellow, magenta, cyan, light cyan, light magenta, blue, green red, to name a few. For the purposes of illustration, pens 52–56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics.

The printer 20 uses an "off-axis" ink delivery system, having main stationary reservoirs (not shown) for each ink (black, cyan, magenta, yellow) located in an ink supply region 58. In this respect, the term "off-axis" generally refers to a configuration where the ink supply is separated from the print heads 50–56. In this off-axis system, the pens 50–56 may be replenished by ink conveyed through a series of flexible tubes (not shown) from the main stationary reservoirs so only a small ink supply is propelled by carriage 40 across the print zone 35 which is located "off-axis" from the path of printhead travel. Some or all of the main stationery reservoirs may be located in a region generally away from the interior of the printer 20. In addition, the number of main stationary reservoirs may vary and is not required to equal the number of cartridges 50–56 utilized in the printer 20. In this respect, the printer 20 may include a lesser or greater number of reservoirs than the number of cartridges 50–56. As used herein, the term "pen" or "cartridge" may also refer to a replaceable printhead cartridge where each pen has a reservoir that carries the entire ink supply as the printhead reciprocates over the print zone 35.

The illustrated pens 50–56 have printheads 60–66, respectively, which selectively eject ink to form an image on a sheet of media 34 in the print zone 35. These printheads 60–66 have a large print swath, for instance about 20 to 25 millimeters (about one inch) wide or wider, although the concepts described herein may also be applied to smaller or larger printheads. The printheads 60–66 each have an orifice plate with a plurality of nozzles formed therethrough in a manner well known to those skilled in the art.

The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead. The illustrated printheads 60–66 may comprise thermal inkjet or piezoelectric printheads, although other types of printheads may be used.

In general, thermal inkjet printheads typically include a plurality of resistors which are associated with the nozzles. Upon energizing a selected resistor, a bubble of gas is formed which ejects a droplet of ink from the nozzle and onto a sheet of print medium in the printzone 35 under the nozzle. The printhead resistors are selectively energized in response to firing command signals delivered from the controller 30 to the printhead carriage 40. Piezoelectric printheads typically include a plurality of piezoelectric elements (not shown), i.e., pieces of material that deform under the influence of an electric field to thus increase the pressure within a chamber, associated with the nozzles. Upon energizing a selected piezoelectric element, the space containing fluid to be fired through a nozzle is decreased and the pressure within the space is increased. The increased pressure causes a droplet of fluid to be forcibly ejected from the nozzle and onto the print medium in the printzone 35 under the nozzle. The piezoelectric elements are selectively energized in this manner in response to firing command signals delivered from the controller 30 to the printhead carriage 40.

Figure 2:
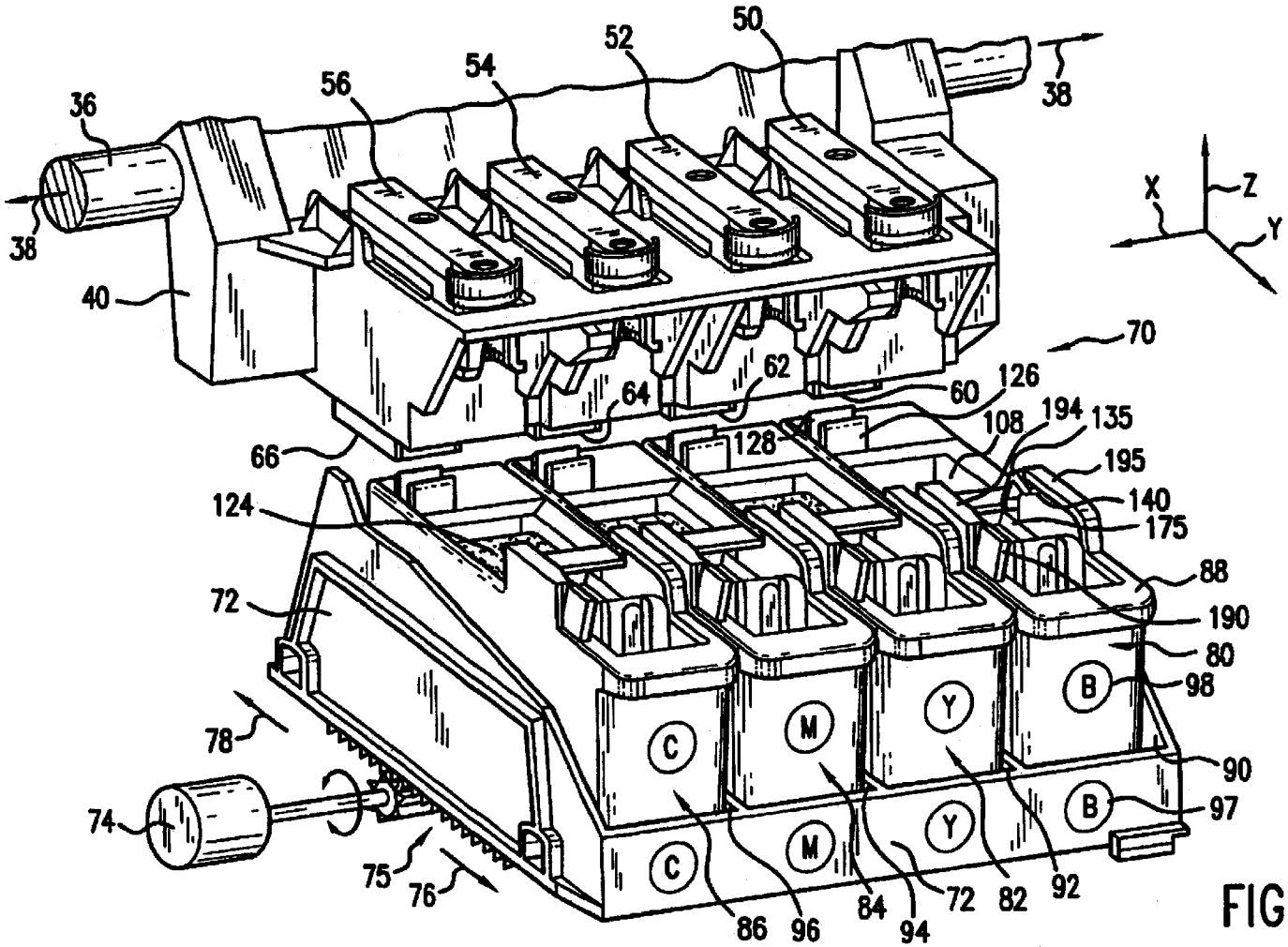
FIG. 2 is an enlarged perspective view of the service station system of FIG. 1.

FIG. 2 shows the carriage 40 positioned with the pens 50–56 ready to be serviced by a replaceable printhead cleaner service station system 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54, and 56. Each of the cleaner units 80–86 includes an installation and removal handle 88, which may be gripped by an operator when installing the cleaner units 80–86 in their respective chambers or stalls 90, 92, 94, and 96 defined by the service station pallet 72. Following removal, the cleaner units 80–86 are typically disposed of and replaced with a fresh unit, so the units 80–86 may also be referred to as "disposable cleaner units." To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

Each of the cleaner units 80–86 also includes a spittoon chamber 108 for receipt of spitted ink. For the color cleaner units 82–86, the spittoon 108 may be filled with an ink absorber 124, preferably of a foam material, although a variety of other absorbing materials may also be used. The absorber 124 receives ink spit from the color printheads 62–66, and holds this ink while the volatiles or liquid components evaporate, leaving the solid components of the ink trapped within the chambers of the foam material. The spittoon 108 of the black cleaner unit 80 may be supplied as an empty chamber, which then fills with the tar-like black ink residue over the life of the cleaner unit.

Each of the cleaner units 80–86 includes a dual bladed wiper assembly which preferably has two wiper blades 126 and 128, which are preferably constructed with rounded exterior wiping edges, and an angular interior wiping edge, as described in the Hewlett-Packard Company's U.S. Pat. No. 5,614,930. The disclosure of which is hereby incorporated by reference in its entirety. Preferably, each of the wiper blades 126, 128 is constructed of a flexible, resilient, non-abrasive, elastomeric material, such as nitrile rubber, or more preferably, ethylene polypropylene diene monomer (EPDM), or other comparable materials known in the art. For the wipers blades 126 and 128, a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

For assembling the black cleaner unit 80, which is used to service the pigment based ink within the black pen 50, an ink solvent chamber (not shown) receives an ink solvent, which is held within a porous solvent reservoir body or block installed within the solvent chamber. Preferably, the reservoir block is made of a porous material, for instance, an open-cell thermoset plastic such as a polyurethane foam, a sintered polyethylene, or other functionally similar materials known to those skilled in the art. The inkjet ink solvent is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the reservoir block is soaked with the preferred ink solvent, PEG.

To deliver the solvent from the reservoir, the black cleaner unit 80 includes a solvent applicator or member 135, which underlies the reservoir block.

Each of the cleaner units 80–86 also includes a cap retainer member 175 which can move in the Z axis direction, while also being able to tilt between the X and Y axes, which aids in sealing the printheads 60–66. The retainer 175 has an upper surface which may define a series of channels or troughs, to act as a vent path to prevent depriming of the printheads 60–66 upon sealing, for instance as described in U.S. Pat. No. 5,867,184, currently assigned to the present assignee, the Hewlett-Packard Company. The disclosure of which is hereby incorporated by reference in its entirety.

Each of the cleaner units 80–86 also includes a snout wiper 190 for cleaning a rearwardly facing vertical wall portion of the printheads 60–66, which leads up to an electrical interconnect portion of the pens 50–56. The snout wiper 190 includes abase portion which is received within a snout wiper mounting groove 194 defined by the unit cover. While the snout wiper 190 may have combined rounded and angular wiping edges as described above for wiper blades 126 and 128, blunt rectangular wiping edges are preferred since there is typically no need for the snout wiper to extract ink from the nozzles. The unit cover also includes a solvent applicator hood 195, which shields the extreme end of the solvent applicator 135 and the a portion of the retainer member 175 when assembled.

Figure 3:
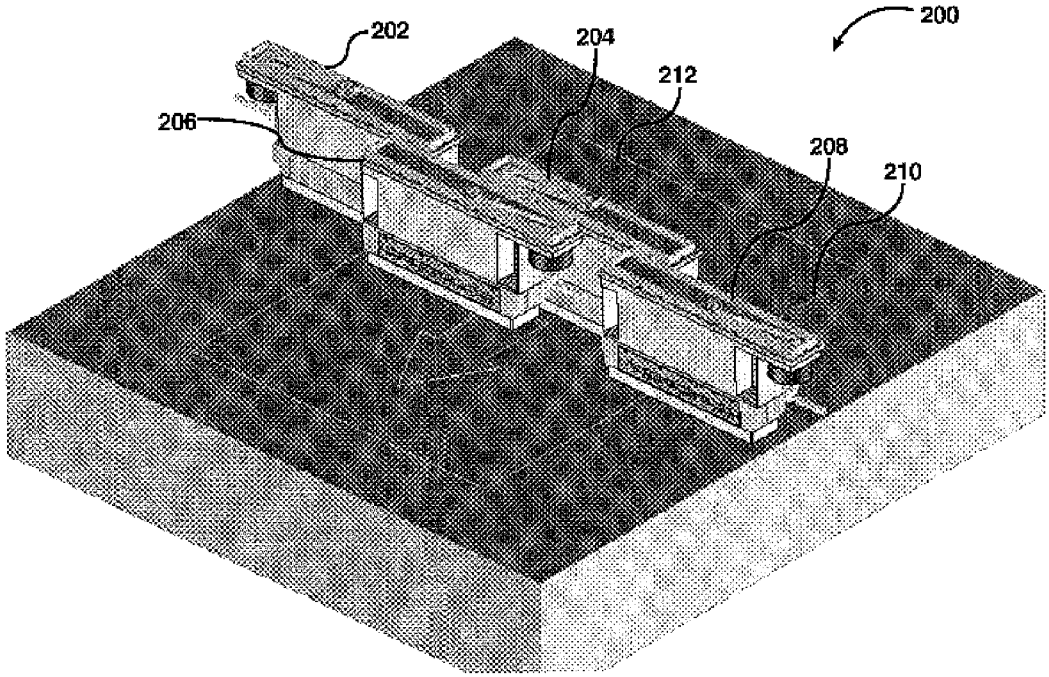
FIG. 3 is a perspective sectional view of another form of an inkjet printing mechanism, here an inkjet printer having a plurality of stationary ink ejection elements.

FIG. 3 is a perspective sectional view of another form of an inkjet printing mechanism, here an inkjet printer 200 having a plurality of stationary ink ejection elements 202–208. In comparison to the inkjet printer 20 illustrated in FIG. 1, the inkjet printer 200 includes a plurality of ink ejection elements 202–208 that remain relatively stationary over a print zone 210 during its use. In this respect, ink drops from the stationary ink ejection elements 202–208 may be applied onto a sheet of print media 212 as it travels through the print zone 210.

Figure 4A:
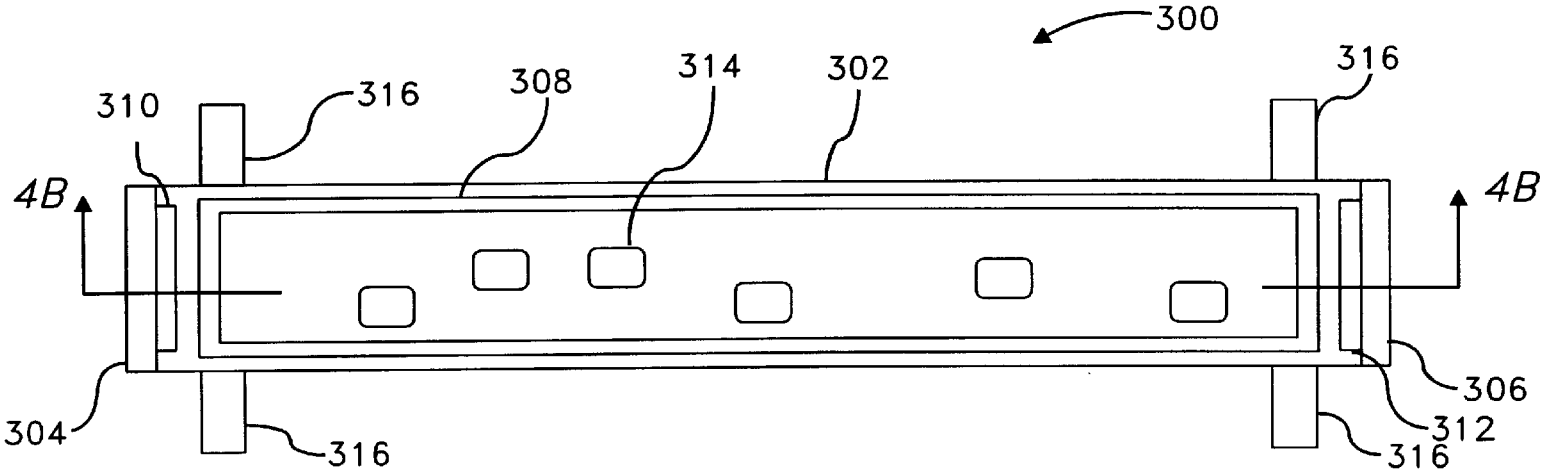
FIG. 4A is a top plan view of a schematically illustrated capping sled in accordance with an embodiment of the present invention.

Referring now to FIG. 4A, there is shown a top plan view of a schematically illustrated capping sled 300 (e.g., cap retaining member 175 illustrated in FIG. 2) in accordance with a preferred embodiment of the present invention. The capping sled 300 may be part of the service station system 70 illustrated in FIG. 2. In this respect, the capping sled 300 may be implemented to cap the ink ejection elements (i.e., printheads 50–56) when the ink ejection elements are not in use as described hereinabove with respect to the cap retaining member 175.

The capping sled 300 is generally composed of a substrate 302. Although the substrate 302 may be formed any suitable material, it is preferably formed of a plastic material. The substrate 302 includes a pair of upstanding members 304, 306 that protrude generally perpendicularly to the longitudinal axis of the substrate 302. The upstanding members 304, 306 are spaced apart from one another at a distance slightly longer than the length of the ink ejection element. In this respect, at least a portion of the bottom of the ink ejection element may be fitted between the upstanding members 304, 306.

Absorbent pads 310, 312 are respectively mounted on facing sides of the pair of upstanding members 304, 306. Generally speaking, the absorbent pads 310, 312 may comprise any reasonably suitable liquid absorbent material, e.g., felt, pressboard, sponge, etc. The absorbent pads 310, 312 may be mounted on their respective upstanding members 304, 306 by any reasonably suitable manner, e.g., adhesive, hook and loop fastener, metal fastener, etc. Preferably, the absorbent pads 310, 312 are mounted to the upstanding members 304, 306 with fasteners that enable the absorbent pads to be removed and replaced, e.g., to enable simple replacement of the pads.

The absorbent pads 310, 312 are positioned on the upstanding members 304, 306 to generally enable the cleaning of the sides of an ink ejection element. In this respect, the absorbent pads 310, 312 are positioned to wipe against side edges of the ink ejection element, as will be described in further detail hereinbelow.

The capping sled 300 also includes a seal member 308 configured to humidically seal the printhead nozzles from contaminants and drying. As illustrated in FIG. 4A, the seal member 308 generally encloses an area above the substrate 302. However, the seal member 308 may include a series of channels or troughs, to act as a vent path to prevent depriming of the ink ejection elements upon sealing as described hereinabove.

Located at various positions on a top surface of the substrate 302 are a plurality of absorbent pads 314. Generally speaking, the absorbent pads 314 may comprise any reasonably suitable liquid absorbent material, e.g., felt, pressboard, sponge, etc. The absorbent pads 314 may be mounted on the substrate 302 by any reasonably suitable manner, e.g., adhesive, hook and loop fastener, metal fastener, etc. The absorbent pads 314 may be placed on the substrate 302 at locations that correspond to positions on the ink ejection element that may have been found to accumulate ink and other debris.

Figure 7:
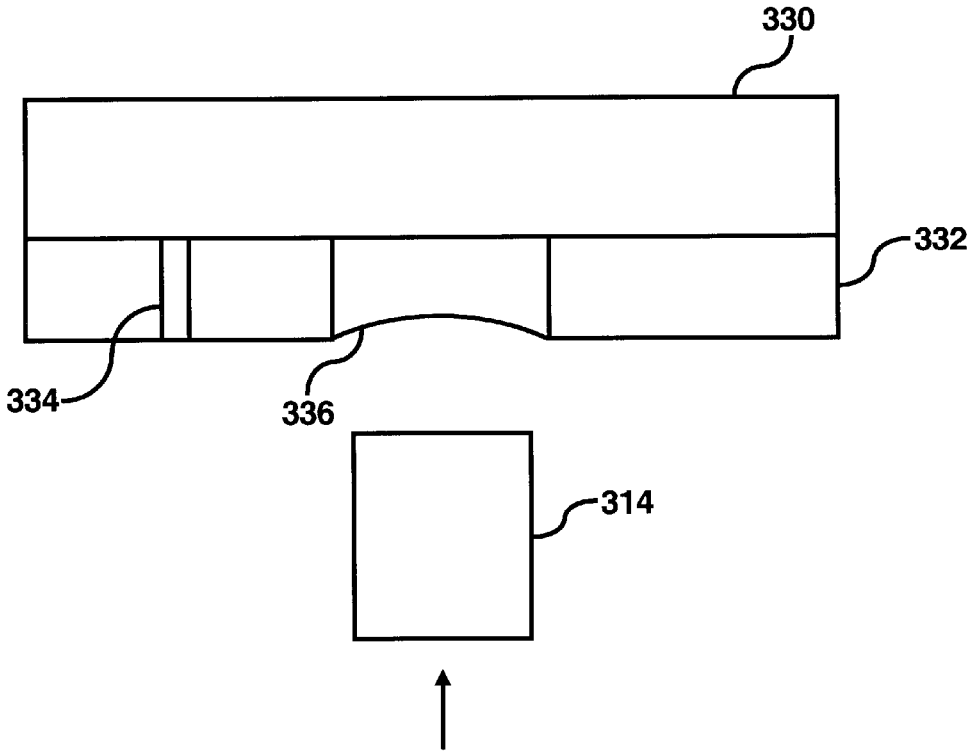
FIG. 7 is a schematic illustration of an exemplary manner in which an absorbent pad may be implemented to clean a portion of an ink ejection element according to an embodiment of the present invention.

By way of example, as illustrated in FIG. 7, an enlarged, schematic sectional view of an ink ejection element 330 is depicted as including a cavity 336. Also shown in FIG. 7 are a nozzle plate 332 containing a nozzle 334. The cavity 336 may comprise various non-planar areas on the bottom surface of the ink ejection element 330 that are prone to accumulate ink and other debris, for example, during a wiping operation. In this respect, according to a preferred embodiment, testing may be conducted to determine locations (e.g., cavity 336) on the bottom surface of the ink ejection element 330 that may benefit most from contact with the absorbent pads 314. In another respect, the absorbent pads 314 may also be positioned on the substrate 302 to substantially prevent contact with the nozzles of the ink ejection element 330. As shown in FIG. 7, the absorbent pad 314 is comprised of a width that may enter the cavity 336 while preventing contact with the nozzle 334.

By virtue of the position of the absorbent pads 310–314 on the substrate 302 and the upstanding members 304, 306, when the capping sled 300 is operated to cap an ink ejection element, the absorbent pads 310–314 are designed to contact predetermined locations on the ink ejection element 330. One result of which is to substantially remove ink and debris from the predetermined locations on the bottom surface of the ink ejection element 330.

According to a preferred embodiment, the substrate 302 also includes a pair of cylindrical side protrusions 316 respectively located on either side of the substrate 302. The side protrusions 316 may be integrally formed with the substrate 302 or it may be attached to the substrate 302 in any reasonably suitable manner known to those skilled in the art, e.g., adhesive, metal fasteners, ultrasonic welding, etc. As will described in greater detail hereinbelow, the side protrusions 316 are generally provided as a mechanism for enabling the capping sled 300 to move in a generally vertical direction in response to a horizontal movement of a supporting carriage (not shown).

Figure 4B:
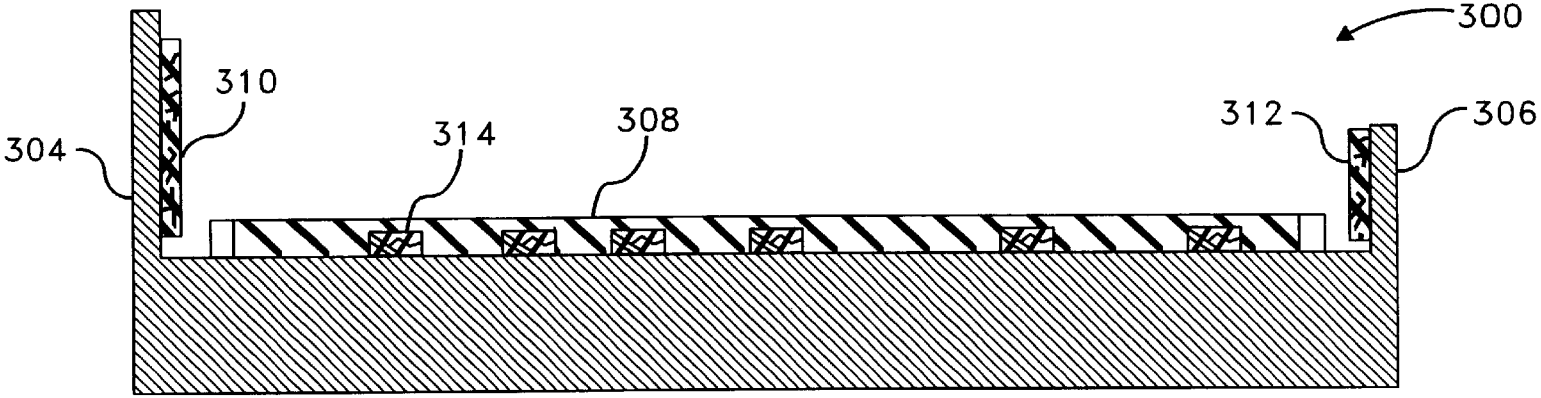
FIG. 4B is a cross-sectional side view the capping sled taken along lines III—III in FIG. 4A.

Referring now to FIG. 4B, there is illustrated a cross-sectional side view of the capping sled 300 taken along lines III—III in FIG. 4A. As shown in FIG. 4B, the upstanding members 304, 306 may be integrally formed with the substrate 302. According to a preferred embodiment, one of the upstanding members 304 (and the absorbent pad 310) extends to a height generally higher than the other upstanding member 306. In one regard, the relatively higher height of the upstanding member 304 (and the absorbent pad 310) may be useful in engaging a side of the ink ejection element 330.

In addition, the absorbent pads 314 are of a height that is slightly lower than the height of the seal member 308. However, the absorbent pads 314 may extend to a height higher than the seal member 308 to therefore become compressed during a capping operation without departing from the scope of the present invention.

Figure 5A:
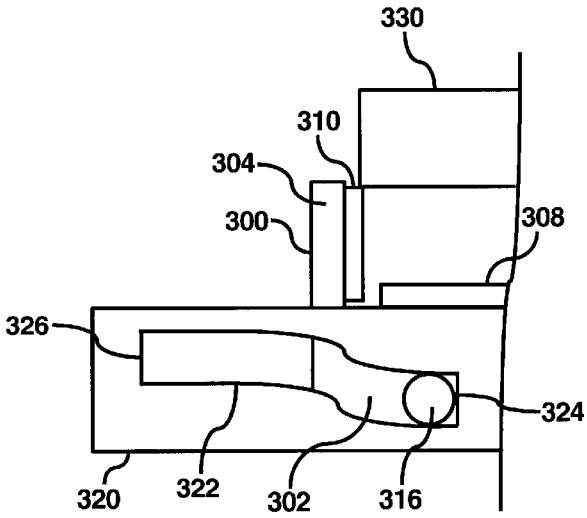
FIGS. 5A–5C illustrate highly schematic sectional views of the capping sled of FIG. 3A at various positions during a capping procedure in accordance with an embodiment of the present invention.
Figure 5B:
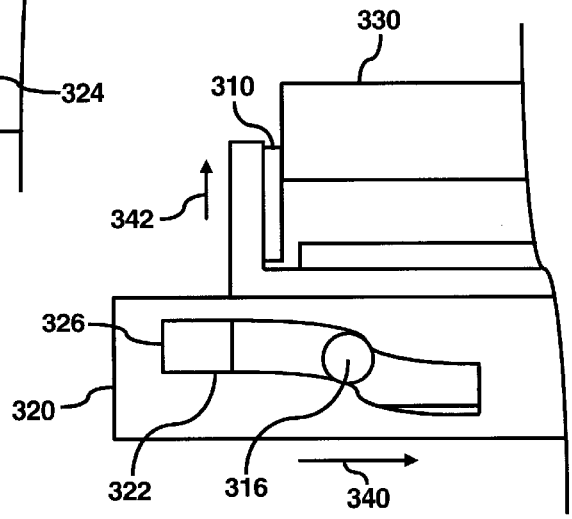
Figure 5C:
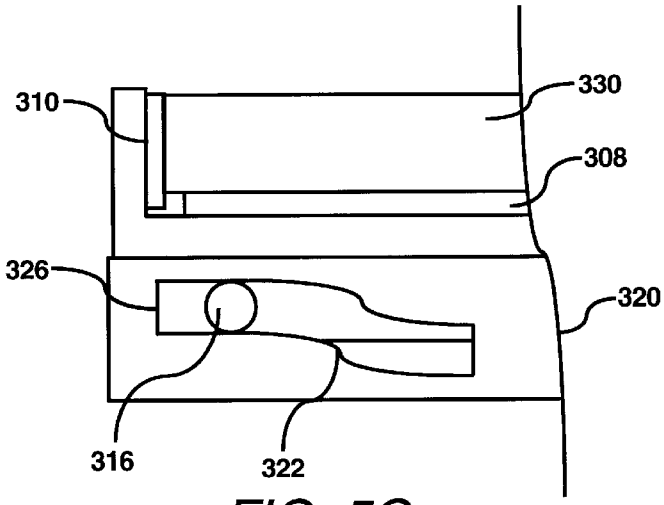

FIGS. 5A–5C illustrate highly schematic sectional views of the capping sled 300 of FIG. 4A at various positions during a capping procedure in accordance with an embodiment of the present invention.

With respect first to FIG. 5A, there is shown a portion of an ink ejection element 330 in position to undergo a capping procedure. The capping sled 300 is positioned on a carriage 320 through a mating configuration of the side protrusions 316 and respective slotted openings 322 (only one opening is shown) located on the carriage 320. According to a preferred embodiment, the side protrusions 316 are mated to both sides of the carriage 320 in the manner illustrated in FIG. 5A.

The slotted opening 322 includes a first section 324 that is generally lower than a second section 326. Prior to initiating the capping procedure, the side protrusion 316 is located generally adjacent to the first section 324. In addition, the upstanding member 304 is positioned generally adjacent to a side surface of the ink ejection element 330. It should be understood that the upstanding member 306 is also positioned generally adjacent to the opposite side surface of the ink ejection element 330.

As shown in FIG. 5B, as the carriage 320 moves in the direction indicated by arrow 340, the capping sled 300 is configured to move in the direction indicated by arrow 342. The capping sled 300 is thus designed to travel in a substantially vertical direction generally towards the ink ejection element 330 with the substantially horizontal travel of the carriage 320. This relative motion may be effectuated by maintaining the horizontal position of the capping sled 300 in a fixed position with respect to the carriage 320. By maintaining this horizontal position, the side protrusion 316 is enabled to travel in the slot 322 generally towards the second section 326. By virtue of the various heights of the slot 322, the side protrusion 316 is caused to move in a generally vertical direction, thereby causing the capping sled 300 to which it is attached to also move in a generally vertical direction.

As also illustrated in FIG. 5B, as the capping sled 300 moves in the generally vertical direction, the absorbent pad 310 contacts the side of the ink ejection element 330. In this respect, the generally vertical movement of the absorbent pad 310 substantially enables the absorbent pad 310 to clean off ink and other debris from the side of the ink ejection element 330. The ink and other debris may accumulate on the side of the ink ejection element 330 by operation of wipers as described hereinabove.

The carriage 320 may be caused to move in the direction 340 for a predetermined period of time. As illustrated in FIG. 5C, the capping sled 300 moves in a generally vertical direction until the side protrusion 316 nears the second section 326 of the slot 322. At this point, the ink ejection element 330 is generally seated on the sealing member 308 and is in a capped position. In addition, although not visible in FIG. 5C, predetermined locations of the ink ejection element 330 are in contact with the absorbent pads 314, thereby enabling the absorbent pads 314 to substantially clean off ink and debris located on those predetermined locations.

As mentioned previously, it may be deleterious to allow the absorbent pads 314 to contact the nozzles of the ink ejection element. In one respect, such contact may cause ink contained in the nozzles to become absorbed into the absorbent pads 314 by virtue of the capillarity in the absorbent material. The absorption of ink from the nozzles may cause problems in the printing operation as well as waste ink. The problems associated with the contact are beyond the scope of this disclosure and will thus not be further described.

By reversing the operations illustrated in FIGS. 5A–5C, the absorbent pad 310 is generally able to clean off the side of the ink ejection element 330 a second time.

FIGS. 5A–5C together illustrate a preferred manner of maneuvering the capping sled 300. It should be understood that any other reasonably suitable configuration of maneuvering the capping sled 300 in a substantially vertical direction toward the ink ejection element may be implemented in the present invention without departing from the scope of the present invention. The discussion of FIGS. 5A–5C generally reference the capping sled 300 as being operated during a capping process. Although this is the preferred embodiment, it may also be possible effectuate cleaning of the ink ejection element as a separate operation, generally independent of the capping operation.

According to another embodiment, the absorbent pads 310–314 may be moistened prior to performance of the capping operation. The absorbent pads 310–314 may absorb an amount of ink to thereby enable greater absorption of dried ink on the ink ejection element surface. The moistening of the absorbent pads 310–314 may be carried out manually, or a separate component (not shown) may be installed on or near the capping sled 300 to effectuate the moistening.

Figure 6:
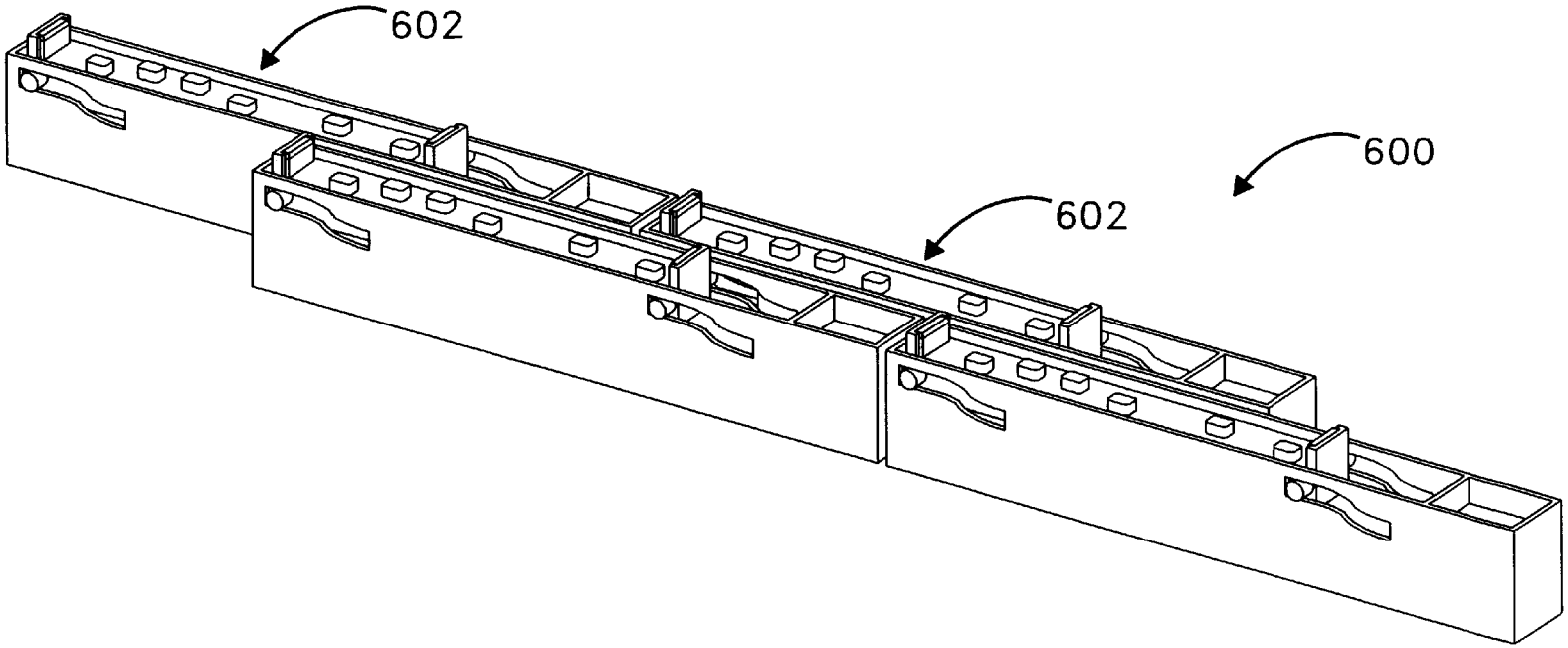
FIG. 6 is a perspective view of a capping sled configured for use with the inkjet printing mechanism illustrated in FIG. 3.

FIG. 6 is a perspective view of an arrangement 600 of capping sleds 602 configured for use with the inkjet printing mechanism 200 illustrated in FIG. 3. The capping sleds 602 are arranged in a pattern to receive the ink ejection elements 202–208. In this respect, each of the ink ejection elements 202–208 may simultaneously be cleaned. It should be understood that each of the capping sleds 602 may contain the elements described hereinabove with respect to the capping sled 300. In addition, the capping sleds 602 may operate in a similar manner to the above-described capping sled 300.

By virtue of the substantially vertical movement of the capping sled 300, 602 with respect to the ink ejection element 330, only those absorbent pads 310, 312 located on the upstanding members 304, 306 are caused to slide against the ink ejection element 330. In this respect, the absorbent pads 314 are caused to contact the ink ejection element substantially without any relative transverse movement therebetween. Therefore, the absorbent pads 314 are considerably less likely to damage the nozzles and/or further spread ink and debris around the bottom surface of the ink ejection element.

The cleaning of the ink ejection element may preferably be performed during a scheduled capping operation. Therefore, cleaning of the ink ejection element performed by the capping sled 300, 602 may form part of a servicing routine of an image forming device. In this respect, the performance of the ink ejection element cleaning operation may be performed without necessitating any additional time, which thereby does not negatively affect throughput.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A system for cleaning an ink ejection element having a plurality of nozzles, said system comprising:

a device having a substrate supporting at least one absorbent pad located at a first location on said substrate, wherein said first location corresponds to a second location on said ink ejection element, said second location being free of said plurality of nozzles, whereby said at least one absorbent pad is substantially prevented from contacting any of said plurality of nozzles.

2. The system according to claim 1, wherein said device further includes a seal member enclosing a plurality of said at least one absorbent pad.

3. The system according to claim 1, wherein the substrate comprises at least one upstanding member located at a position wherein wiping of said ink ejection element results when said device is moved relative to said ink ejection element.

4. The system according to claim 3, wherein at least one upstanding absorbent pad is mounted on at least one side of said upstanding member.

5. The system according to claim 1, wherein said substrate is configured to move said at least one absorbent pad into contact with a location on said ink ejection element which is particularly likely to have ink build up, but which does not define an ink ejecting nozzle.

6. The system according to claim 1, wherein said substrate is movably mounted on a carriage of a service station, the carriage being configured to move in a substantially horizontal direction.

7. The system according to claim 6, wherein said substrate is configured to move in a substantially vertical direction with respect to the ink ejection element with said substantially horizontal movement of said carriage.

8. The system according to claim 1, wherein said second location on said ink ejection element is a non-planar location tending to accumulate debris.

9. A method of cleaning ink ejection elements of an image forming mechanism having a plurality of nozzles, said method comprising:

maneuvering a device having at least one absorbent pad in a substantially vertical direction towards a bottom surface of said image forming mechanism; and contacting said at least one absorbent pad with a predetermined location on said image forming mechanism when said device is substantially close to said image forming mechanism to thereby remove debris from said image forming mechanism, wherein said predetermined location does not include any of said plurality of nozzles.

10. The method according to claim 9, wherein said step of contacting said at least one absorbent pad comprises contacting said at least one absorbent pad with a side of said ink ejection element.

11. The method according to claim 9, wherein said step of maneuvering said device comprises maneuvering a carriage supporting said device in a substantially horizontal direction.

12. The method according to claim 9, further comprising:

maneuvering said device during a capping operation of said ink ejection element.

13. The method according to claim 9, further comprising:

moistening said at least one absorbent pad prior to said step of contacting said at least one absorbent pad with said ink ejection element.

14. The method according to claim 9, wherein said step of maneuvering said device comprises substantially preventing relative horizontal movement between said at least one absorbent pad and said ink ejection element.

15. The method according to claim 9, further comprising:

wiping said ink ejection element with a wiper prior to maneuvering said device towards said ink ejection element.

16. An image forming mechanism comprising:

an ink ejection element having a plurality of nozzles, said ink ejection element configured to undergo cleaning operations at a service station;

said service station including a wiper for selectively wiping the ink ejection element and a carriage movably supporting a cleaning device;

said cleaning device including at least one absorbent pad; and said at least one absorbent pad being positioned on said cleaning device to substantially prevent contact with any of said plurality of nozzles when said ink ejection element is cleaned by said cleaning device.

17. The image forming mechanism according to claim 16, wherein said cleaning device includes a pair of upstanding members spaced apart a distance approximately equal to the length of the ink ejection element.

18. The image forming mechanism according to claim 17, wherein each of said upstanding members includes an absorbent pad positioned to contact the ink ejection element when said ink ejection element is cleaned with said cleaning device.

19. The image forming mechanism according to claim 16, wherein said cleaning device is coupled to said service station in a manner to enable the cleaning device to move in a substantially vertical direction with substantially horizontal motion of said service station.

20. The image forming mechanism according to claim 16, wherein said cleaning device includes a plurality of absorbent pads, each of said absorbent pads being positioned to contact various portions of said ink ejection element.

21. The image forming mechanism according to claim 20, wherein said various portions of said ink ejection element are free of any of said nozzles.

22. The image forming mechanism according to claim 16, wherein said cleaning device is an apparatus for capping said ink ejection element.

23. A system for cleaning an ink ejection element having a plurality of nozzles, said system comprising:

a device having a substrate supporting at least one absorbent pad located at a first location on said substrate, wherein said first location corresponds to a second location on said ink ejection element, said second location being free of said plurality of nozzles, whereby said at least one absorbent pad is substantially prevented from contacting any of said plurality of nozzles;

wherein the substrate comprises at least one upstanding member located at a position generally outside of said ink ejection element when said ink ejection element is capped with said device; and wherein at least one upstanding absorbent pad is mounted on at least one side of said upstanding member.

* * * * *